US009345069B2

(12) United States Patent
Colburn et al.

(10) Patent No.: US 9,345,069 B2
(45) Date of Patent: May 17, 2016

(54) HEAT GENERATION AND EXCHANGE DEVICES INCORPORATING A MIXTURE OF CONDUCTIVE AND DIELECTRIC PARTICLES

(75) Inventors: Michael G. Colburn, Burlington, VT (US); Stephen J. Bogner, Colchester, VT (US); David R. McCloskey, Burlington, VT (US)

(73) Assignee: Wood Stone Ideas, LLC, Bellingham, WA (US)

( * ) Notice: Subject to any disclaimer, the term of this patent is extended or adjusted under 35 U.S.C. 154(b) by 1037 days.

(21) Appl. No.: 13/373,858

(22) Filed: Dec. 2, 2011

(65) Prior Publication Data

US 2012/0138592 A1 Jun. 7, 2012

Related U.S. Application Data

(60) Provisional application No. 61/419,284, filed on Dec. 3, 2010.

(51) Int. Cl.
*H05B 3/14* (2006.01)
*H01B 1/00* (2006.01)

(52) U.S. Cl.
CPC ..... *H05B 3/145* (2013.01); *H05B 2214/04* (2013.01)

(58) Field of Classification Search
CPC ..... H05B 1/02; H05B 3/14; H05B 3/60; H05B 1/00; H05B 3/03
USPC ..... 219/388, 441, 552, 438; 252/502
See application file for complete search history.

(56) References Cited

U.S. PATENT DOCUMENTS

| | | | | |
|---|---|---|---|---|
| 3,676,925 | A | 7/1972 | Sato et al. | |
| 3,999,040 | A * | 12/1976 | Ellis | 219/543 |
| 4,051,454 | A | 9/1977 | Leiser et al. | |
| 4,523,086 | A | 6/1985 | Eilentropp | |
| 4,852,646 | A | 8/1989 | Dittmer et al. | |
| 5,164,443 | A | 11/1992 | Watanabe | |
| 5,348,686 | A | 9/1994 | Vyas | |
| 5,929,138 | A | 7/1999 | Mercer et al. | |
| 6,230,612 | B1 * | 5/2001 | Rossi | 99/446 |
| 6,709,152 | B1 | 3/2004 | Bronlund | |
| 7,037,581 | B2 | 5/2006 | Aramata et al. | |
| 7,049,558 | B2 * | 5/2006 | Baer et al. | 219/548 |
| 7,550,097 | B2 | 6/2009 | Tonapi et al. | |
| 7,781,706 | B2 | 8/2010 | Park | |
| 2003/0118905 | A1 | 6/2003 | Fukuoka et al. | |
| 2008/0251510 | A1 | 10/2008 | Park | |

FOREIGN PATENT DOCUMENTS

| | | | |
|---|---|---|---|
| CA | 2561750 | A1 | 1/2006 |
| CN | 1938790 | B | 5/2001 |
| CN | 1938790 | | 3/2007 |
| CN | 1938790 | A | 3/2007 |
| EP | 1733401 | A1 | 12/2006 |

(Continued)

*Primary Examiner* — Mark Kopec
*Assistant Examiner* — Danny N Kang
(74) *Attorney, Agent, or Firm* — Thomas G. Ference

(57) ABSTRACT

A device for generating heat from an applied current, the device comprises a mixture of conductive particles and dielectric particles. The device includes at least one pair of electrodes disposed within the mixture to direct an applied current through the mixture to resistively heat the mixture. The device may further heat a liquid that flows through the mixture.

14 Claims, 9 Drawing Sheets

(56) References Cited

FOREIGN PATENT DOCUMENTS

| | | | |
|---|---|---|---|
| JP | 04-011666 | A | 1/1992 |
| JP | 4011659 | A | 1/1992 |
| JP | 08-030146 | B2 | 3/1996 |
| JP | 2605163 | B2 | 4/1997 |
| JP | 2007-531217 | A | 11/2007 |
| KR | 10-1995-0001857 | B1 | 3/1995 |
| KR | 10-1995-0002530 | B1 | 3/1995 |
| KR | 20-0360473 | Y1 | 8/2004 |
| KR | 10-2005-0114005 | A | 12/2005 |
| KR | 10-0535175 | B1 | 12/2005 |
| KR | 10-0895786 | B1 | 5/2009 |
| WO | 2005-117034 | A1 | 12/2005 |
| WO | 2006-004282 | A1 | 1/2006 |

* cited by examiner

HEAT GENERATION AND EXCHANGE DEVICES INCORPORATING A MIXTURE OF CONDUCTIVE AND DIELECTRIC PARTICLES

RELATED APPLICATIONS

This application claims the benefit of priority of U.S. Provisional Patent Application No. 61/419,284, filed Dec. 3, 2010 entitled "Ohmic Sand, Gel, or Putty Composition for Heat Generation and Exchange", which is incorporated herein by reference. This patent application is related to U.S. patent application Ser. No. 13/373,859, filed on Dec. 2, 2011, entitled "System for Verifying Temperature Measurement", which is incorporated herein by reference.

FIELD

This patent application generally relates to heat generation by flowing an electrical current through a material. More specifically it relates to ohmically heating a mixture of graphite and dielectric particles and incorporation of that mixture into heat generation devices and exchange devices.

BACKGROUND

Most standard electrical heating systems usually involve using a heating element that is proximate to a material to be heated and transferring heat generated from the heating element to that material by conduction or convection. This process can be inefficient with excess heat being generated in the heating element and that heat escaping beyond the material to be heated. Also, heating elements usually need to be driven to a much higher temperature than the final desired temperature of the material. This is because a high temperature gradient is required to make the conductive or convective process work quickly. A heating element with a temperature much higher than the desired temperature for the material can be a safety problem creating the possibility for burning the user. To fix this problem the device made with a heating element usually requires the use of materials that can withstand higher temperatures and insulation incorporated into the design. This type of heating may also create non-uniform heating within the material.

Ohmic resistive heating is an alternative approach to creating a heating system. This approach involves directly passing a current through the material to be heated. This type of heating generally provides uniform heating of the material, provides more rapid heating, is more efficient and limits the maximum temperature of elements within the system. A drawback of this type of heating is that it is very dependent on the uniformity and resistive properties of the material to be heated.

Thus better types of ohmic materials are needed, as well as different device configurations to utilize these materials. The current patent application provides for a new type of ohmic material and the resulting new devices that incorporate this new material.

SUMMARY

One aspect of the present patent application is directed to a composition for generating heat from an applied current, comprising a mixture of graphite particles and dielectric particles. The graphite particles have a diameter from 1 to 1500 microns. The dielectric particles have a diameter from 1 to 1500 microns. The mixture has a resistivity from 0.015 ohm-meters to 2.3 megaohm-meters.

Another aspect of the present patent application is directed to devices for generating heat from an applied current, each device comprising a mixture of conductive particles and dielectric particles. The device also includes a pair of electrodes disposed within the mixture to direct the applied current through the mixture and the applied current resistively heating the mixture.

BRIEF DESCRIPTION OF DRAWINGS

The foregoing and other aspects and advantages presented in this patent application will be apparent from the following detailed description, as illustrated in the accompanying drawings, in which.

DETAILED DESCRIPTION

FIGS. 1*a* through 9*c* illustrate a composition 20 (variants 20', 20") for heat generation and exchange and the devices made therefrom. Composition 20 comprises a mixture of an electrically conductive substance, preferably graphite, and a thermally conductive, dielectric substance. These substances are mixed at different percentages according to the particular resistivity and heat generation properties desired by the composition. It is appreciated that a mixture of the electrically conductive substance and the dielectric substance is important, since if only the electrically conductive substance were used, a dead short would occur when used to complete electrical connections of a circuit. Similarly if only the dielectric substance were used no current would flow in the circuit. By varying the percentage mixture of the electrically conductive and dielectric substances, an exact resistance can be created.

Figure 1A:
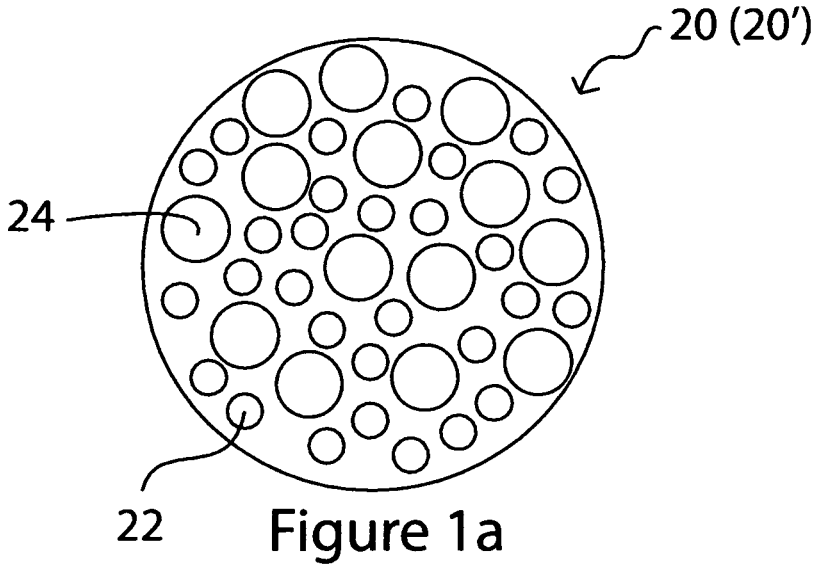
FIG. 1*a* is a schematic representation of a composition according to the present patent application, the schematic depicting a mixture of graphite particles and dielectric particles.

In one embodiment, FIG. 1*a,* composition 20' is a mixture of conductive particles 22 and dielectric particles 24. Conductive particles 22 are preferably graphite. Conductive particles 22 have a diameter from 1 to 1,500 microns. Dielectric particles 24 have a diameter from 1 to 1,500 microns. The upper end of the diameter range governs the uniformity of properties for composition 20'. Particles larger than 1500-microns in diameter will create regions with excessively discrete thermal and electrical properties. The lower end of the diameter range affects the ability of composition 20' to flow. Particles less than 1-micron tend to clump together by Van der Waal forces. Having discrete particles of the appropriate size mixed together creates a mixture with the characteristics of having uniform thermal properties and electrical properties as well as being pourable or able to flow. First, discrete particles allow for ease of mixing and the ability to create a uniform mixture with uniform properties. Second, discrete particles allows for the mixture to be easily poured into devices thus allowing for conformability to different shaped containers, etc. Third, the discrete particles allow the mixture to have reversible deformation properties that are critical in some applications. Dielectric particles 24 are preferably electrically insulative having a resistivity greater than 1-megaohm-meter. Dielectric particles 24 include at least one from the group including silicon dioxide, hydrated magnesium silicate, silicon carbide, and soda-lime glass beads containing sodium carbonate, lime, dolomite, silicon dioxide, aluminum oxide, sodium sulfate, sodium chloride. It is also preferable to have all particles have generally the same relative diameters. By having particles of the same density and roughly the same size, composition 20 is less likely to separate with repeated reversible deformations. It is therefore critical to have the ratio of the radius of the conductive particle divided by the radius of the dielectric particle in a range from 0.2 to 5.

Figure 1B:
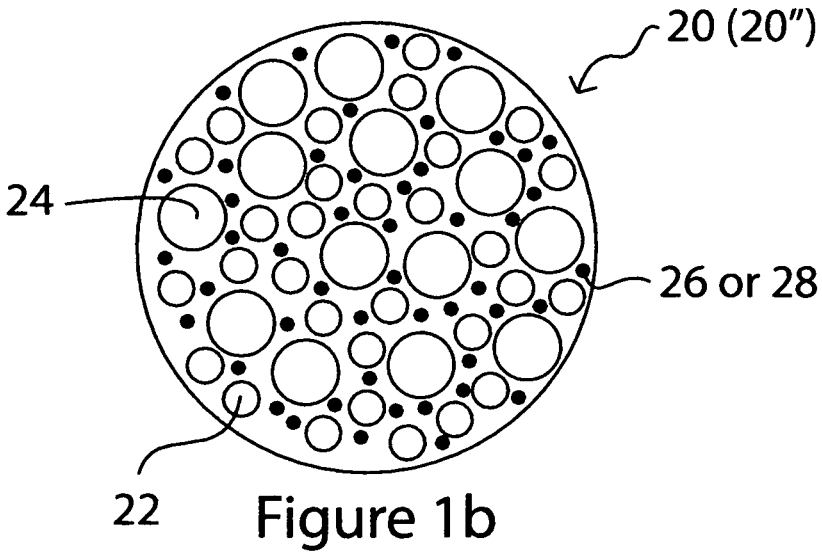
FIG. 1*b* is a schematic representation of another composition where liquid or gel has been incorporated into the composition of FIG. 1*a;*

In one embodiment, FIG. 1*b,* composition 20" includes the composition of 20', which comprises a mixture of conductive particles 22 and dielectric particles 24, and further comprises at least one from the group including a liquid 26 and a gel 28. Liquid 26 and gel 28 fill the space between conductive particles 22 and dielectric particles 24. Liquid 26 and gel 28 may be added to alter physical and electrical properties.

In the embodiment of composition 20" that includes a liquid 26, the liquid may flow through the mixture and be used as a transportation medium for heat generated in the material. An example of such a liquid would be water with a resistivity more than 2.5 ohm-meters. In this case the water itself may be resistively heated as is described in U.S. Pat. No. 7,903,956 by Colburn et al., which is incorporated herein by reference. Other higher boiling temperature liquids such as propylene glycol may be used to transport heat, but not evaporate as quickly as water. Liquids 26 may also be used as binding agents to help bind the solid conductive particles 22 and solid dielectric particles 24 together so composition 20' may take on temporary or permanent shapes.

In the embodiment of composition 20" that includes a gel 28, the gel acts to hold the solid conductive particles 22 and solid dielectric particles 24 together into a pliable material. Gel 28 may be at least one from the group including water, propylene glycol, glycerin, phenoxyethanol and super absorbent polymer. Composition 20" may be conformed to a particular shape before, during or after a current flow is applied thereto. Also, the substances listed above aid both in heat transfer and in the flow of current without the creation of a dead short or interruption of the current flow.

Figure 2A:
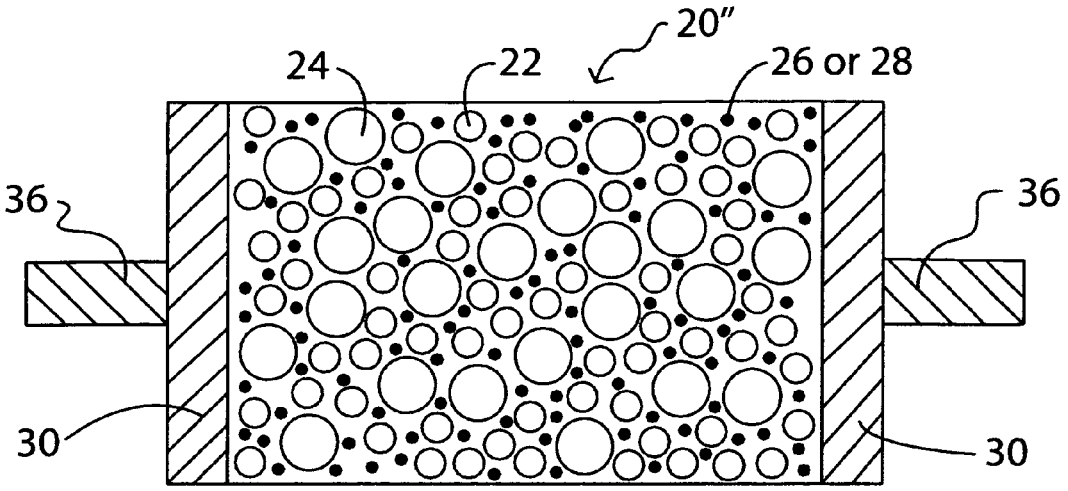
FIG. 2*a* is schematic representation showing a configuration where current is supplied through a pair of electrodes to the composition of FIG. 1*a;*

FIG. 2*a* illustrates how heating occurs by the introduction of a current into composition variant 20", however either variant 20'or 20" of composition 20 could be used. In a preferred embodiment, a pair of electrodes 30 is placed in contact with composition 20 and a potential applied to the electrodes through electrical leads 36 to create a current that flows between the electrodes. Alternatively, a current may be created inductively within composition 20. In either embodiment the applied current is converted to heat, via ohmic resistive heating, to create a uniform temperature throughout the composition 20. The heat is generated without the need for or use of auxiliary heating elements. The composition 20 and electrodes 30 can take many forms and shapes and be used to directly create heat that may then be used directly or conveyed by heat exchange to another material.

Figure 2B:
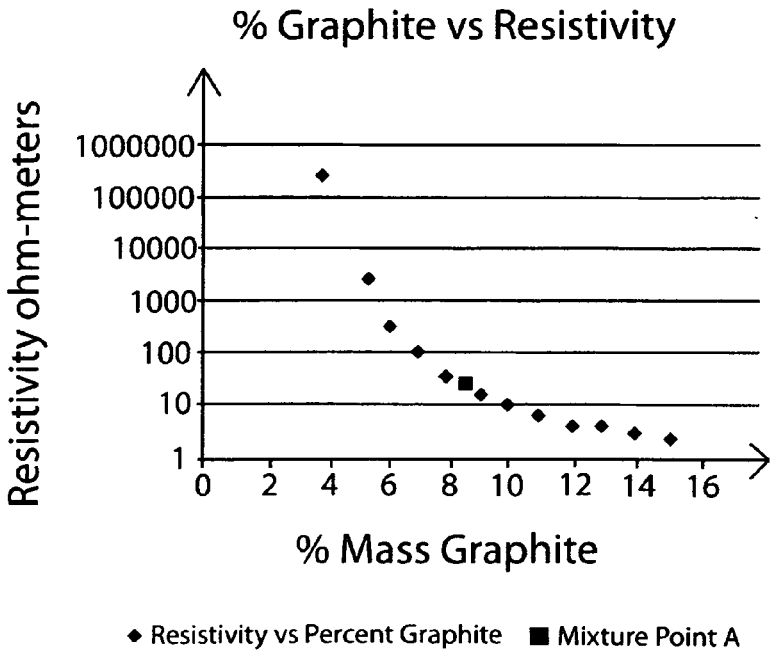
FIG. 2*b* is a graph showing resistivity as a function of composition for one example of the composition depicted in FIG. 1*a;*
Figure 3A:
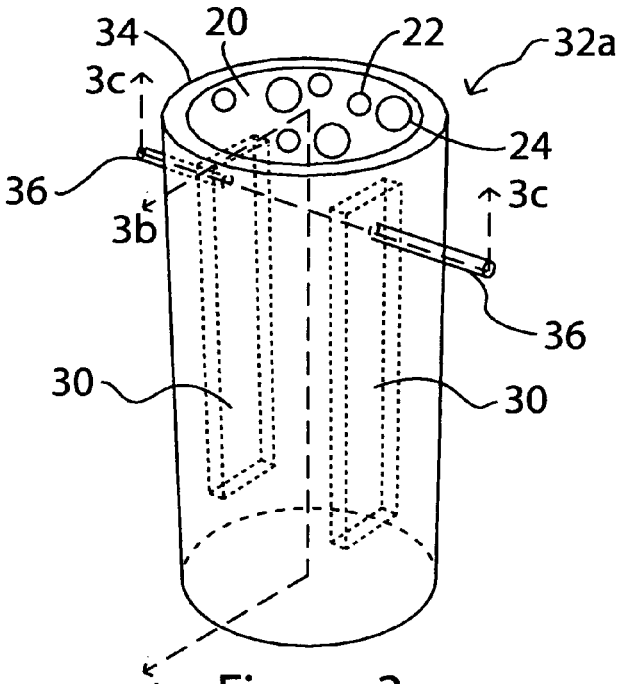
FIG. 3*a* is a perspective view of a device incorporating any of the representative compositions depicted in FIGS. 1*a* and 1*b,* the device for generating heat in the composition.
Figure 3B:
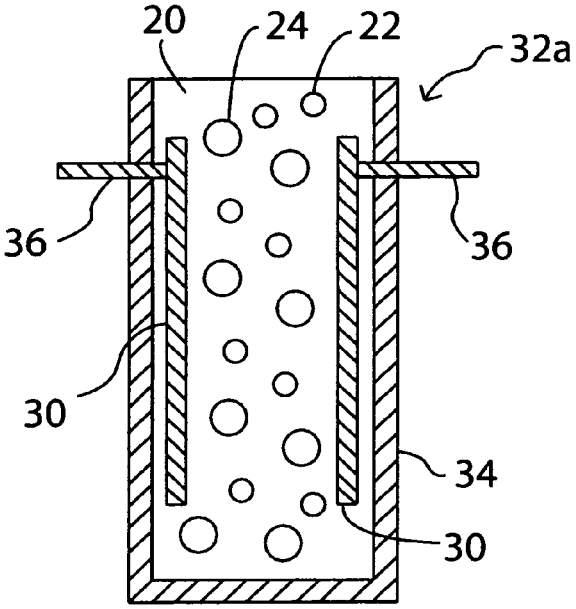
FIG. 3*b* is a side sectional view along line 3*b*-3*b* of the device in FIG. 3*a;*
Figure 3C:
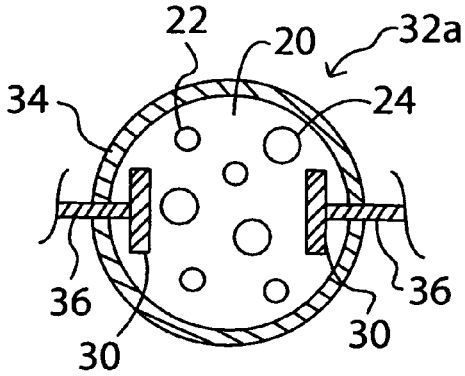
FIG. 3*c* is a top sectional view along line 3*c*-3*c* of the device in FIG. 3*a;*

An exact mixture of conductive particles 22 and dielectric particles 24 may be prepared to create a desired amount of heat in a given size and shape. FIG. 2*b* shows experimentally measured resisitivity as a function of composition for 25-90 micron conductive particles 22 and 150-200 micron dielectric particles 24. Conductive particles 22 were graphite and dielectric particles 24 were soda lime glass. The X-axis scale is linear and shows the mass of the graphite divided by the total mass of the mixture. The Y-axis scale is logarithmic and shows the resistivity of the mixture when compressed with a pressure of 45.3 KPa. FIG. 2*b* illustrates the very large range of resistivities that can be obtained by varying the composition of the mixture between 4% and 15% conductive particles.

Composition 20 may be used in a variety heat generation devices and exchange devices. In one embodiment, FIGS. 3*a*-3*c* heat generating device 32*a* comprises a vessel 34 for holding composition 20. Vessel 34 may take a variety of shapes such as round, flat, tube, pillow plate or bag. Vessel 34 may be a rigid container or flexible encasement, but is non-electrically conducting. Vessel 34 may be thermally insulative or thermally conducting depending on the application. Composition 20 may be any of the compositions 20' and 20" described above. At least one pair of electrodes 30 is disposed within the mixture to direct an applied current through the mixture. Electrodes 30 may be any one of the following materials: graphite, titanium, stainless steel, molybdenum, silver, copper, gold and platinum. Electrical leads 36 connect electrodes 30 to circuitry and a power supply (not shown). The applied current resistively heats the mixture. Device 32*a* may further comprise a temperature sensor 38 and a temperature controller (not shown). Temperature controller is connected to provide electrical energy to one or more pairs of electrodes when the temperature is below a temperature set point. Some applications for device 32*a* are medical heating pads, food transport devices, food warming device, etc.

Figure 4A:
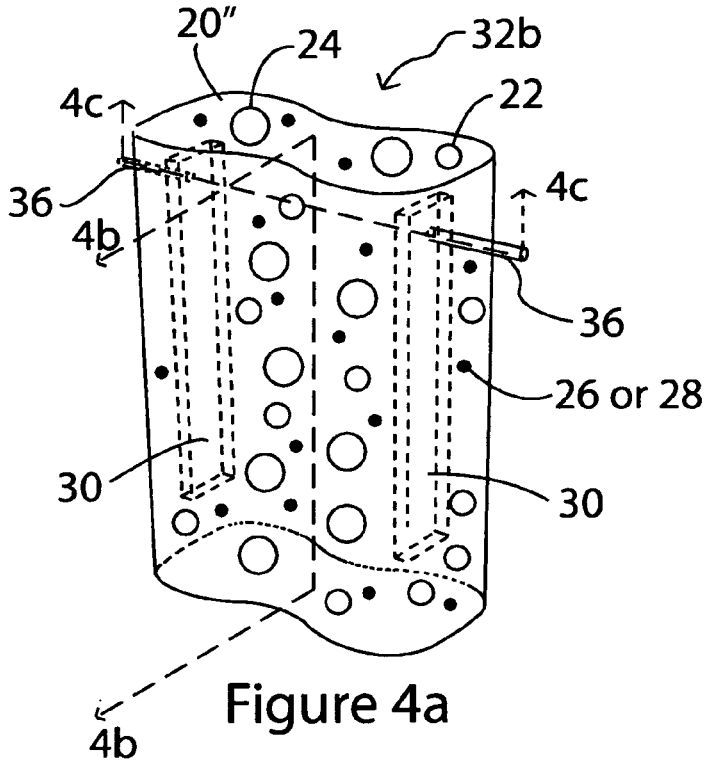
FIG. 4*a* is a perspective view of a device incorporating a representative composition of that depicted in FIG. 1*b,* the device for generating heat in a pliable composition.
Figure 4B:
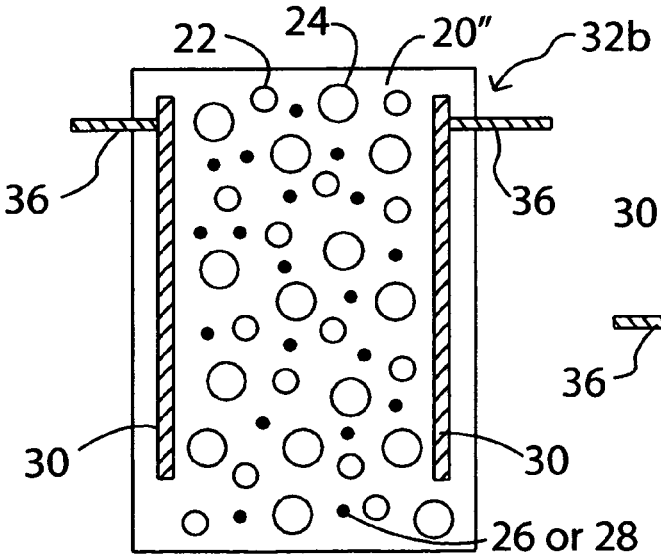
FIG. 4*b* is a side sectional view along line 4*b*-4*b* of the device in FIG. 4*a.*
Figure 4C:
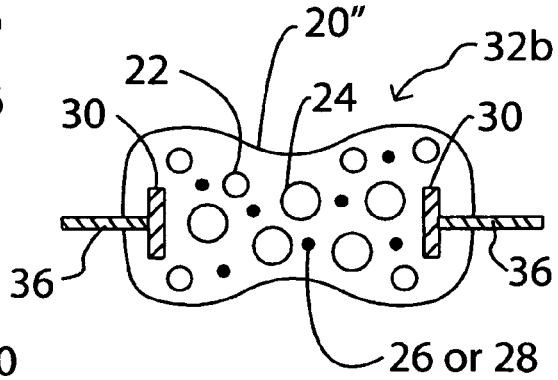
FIG. 4*c* is a top sectional view along line 4*c*-4*c* of the device in FIG. 4*a;*

In one embodiment, FIGS. 4*a*-4*c*, heat generating device 32*b* is comprised of a pliable composition 20" that can be formed into any shape. Device 32*b* may or may not include a vessel 34. Device 32*b* includes at least one pair of electrodes 30 disposed within the mixture to direct an applied current through the mixture. Electrodes 30 may be any one of the following materials: graphite, titanium, stainless steel, molybdenum, silver, copper, gold and platinum. Electrical leads 36 connect electrodes 30 to circuitry and a power supply (not shown). The applied current resistively heats the mixture. Device 32*b* may further comprise a temperature sensor 38 and a temperature controller (not shown). Temperature controller is connected to provide electrical energy to one or more pairs of electrodes when the temperature is below a temperature set point. Some applications for device 32*b* are a pipe-warming device, warming devices that conform around body parts, etc.

Figure 5A:
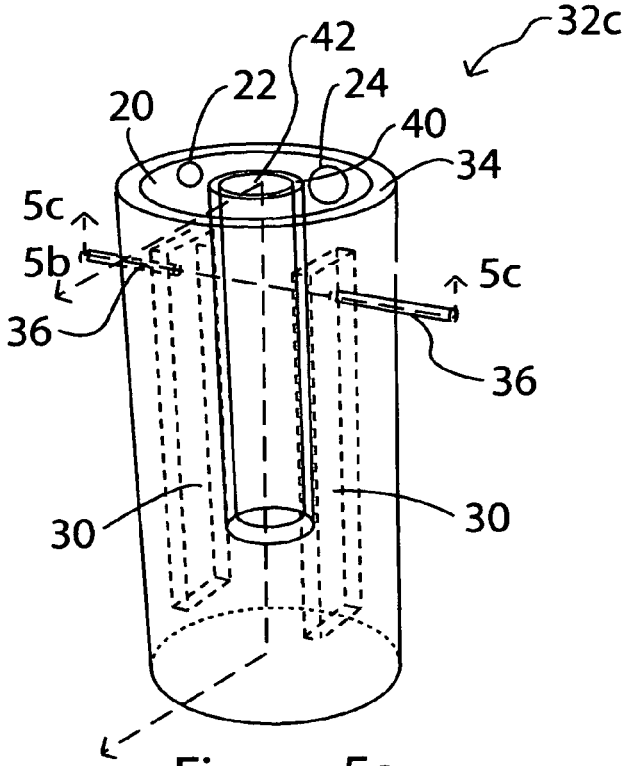
FIG. 5*a* is a perspective view of a device incorporating any of the representative compositions depicted in FIGS. 1*a* and 1*b*, the device is for generating heat in the composition and transferring that heat to a well located within the composition.
Figure 5B:
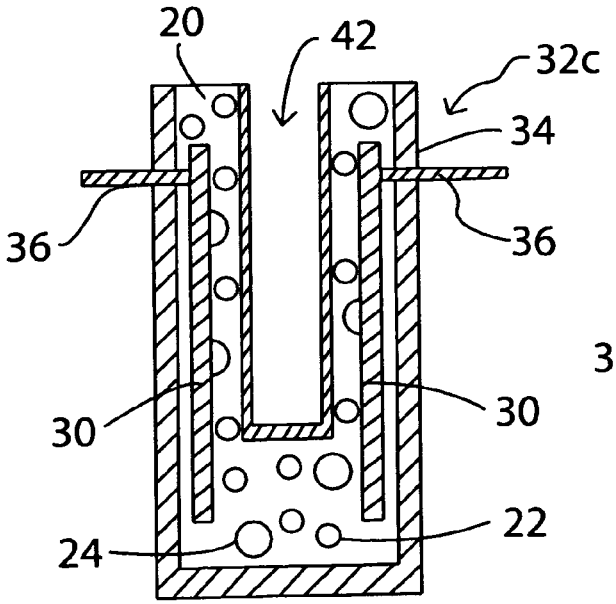
FIG. 5*b* is a side sectional view along line 5*b*-5*b* of the device in FIG. 5*a;*
Figure 5C:
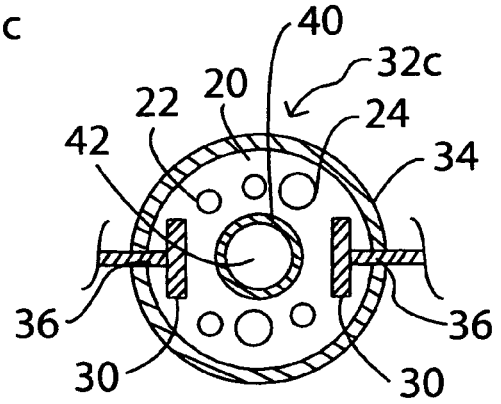
FIG. 5*c* is a top sectional view along line 5*c*-5*c* of the device in FIG. 5*a;*

In one embodiment, FIGS. 5*a*-5*c*, heat generating device 32*c* comprises the elements of device 32*a*, with the added element of sleeve 40 inserted within composition 20. Sleeve 40 creates a cavity 42 that is void of composition 20. Sleeve 40 may be rigid, flexible or elastic. An example application for such a configuration would be for a temperature verifier where temperature sensors to be verified are placed within cavity 42 and their temperature compared to that of the preset temperature of composition 20.

Figure 6A:
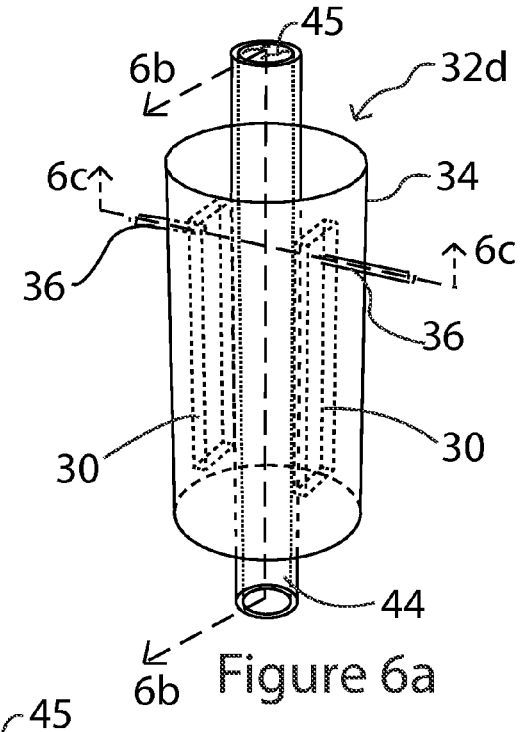
FIG. 6*a* is a perspective view of a device incorporating any of the representative compositions depicted in FIGS. 1*a* and 1*b,* the device is for generating heat in the composition and transferring that heat to a fluid passing through a tube located within the composition.
Figure 6B:
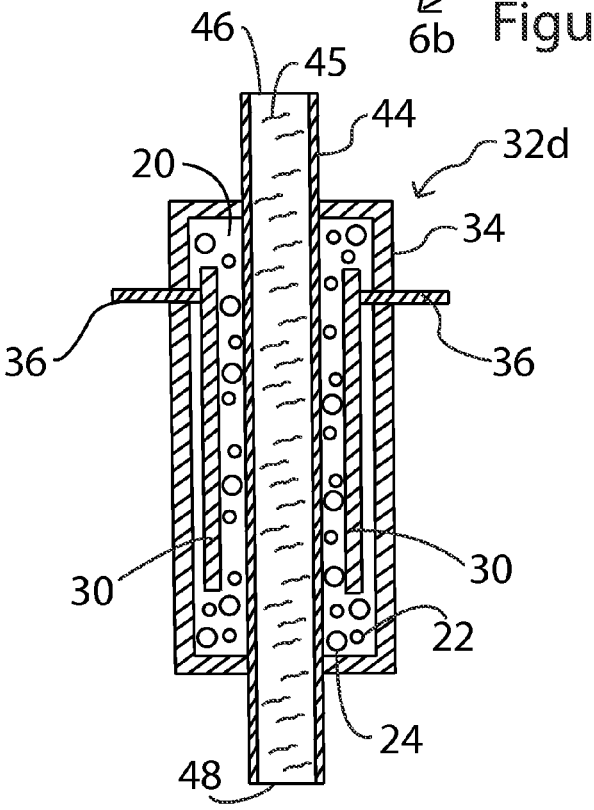
FIG. 6*b* is a side sectional view along line 6*b*-6*b* of the device in FIG. 6*a;*
Figure 6C:
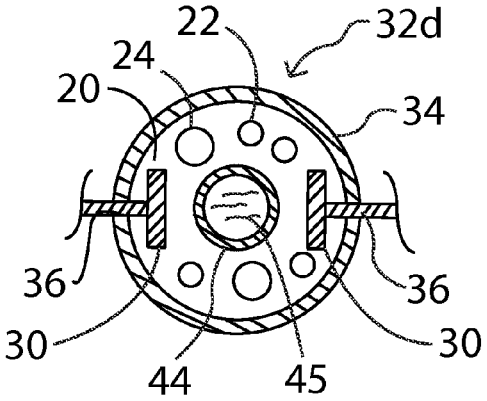
FIG. 6*c* is a top sectional view along line 6*c*-6*c* of the device in FIG. 6*a;*

In one embodiment, FIGS. 6*a*-6*c*, heat generating device 32*d* is used as a heat exchanger. Device 32*d* comprises the elements of device 32*a*, with the added element of tube 44 with a fluid 45 to be heated flows there through. Tube 44 has an entrance orifice 46 and an exit orifice 48. Fluid 45 may be a liquid, gas or slurry that is pumped there through. Fluid 45 is heated by thermal conduction of heat generated in composition 20 that transmit across tube 44 and into the liquid. Some applications for device 32*d* are a food heating device, water heater, radiant space heating devices, etc.

Figure 7A:
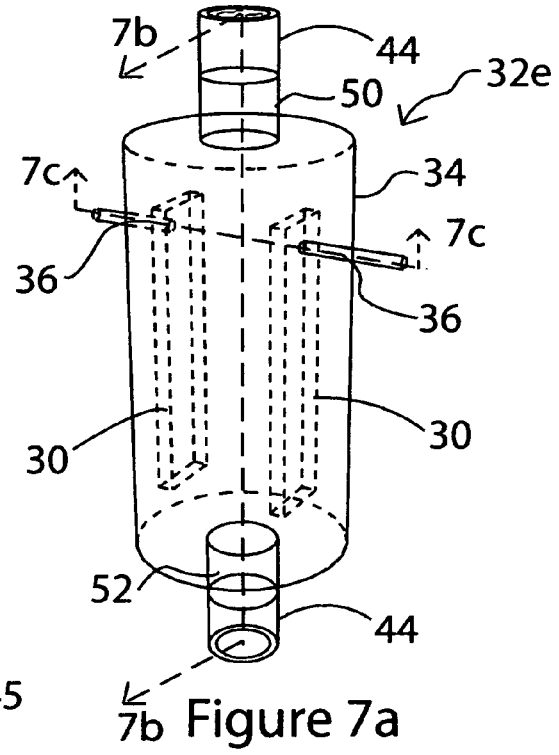
FIG. 7*a* is a perspective view of a device incorporating a representative composition of that depicted in FIG. 1*a,* the device is for generating heat in the composition and transferring that heat directly to a liquid passing through the composition.
Figure 7B:
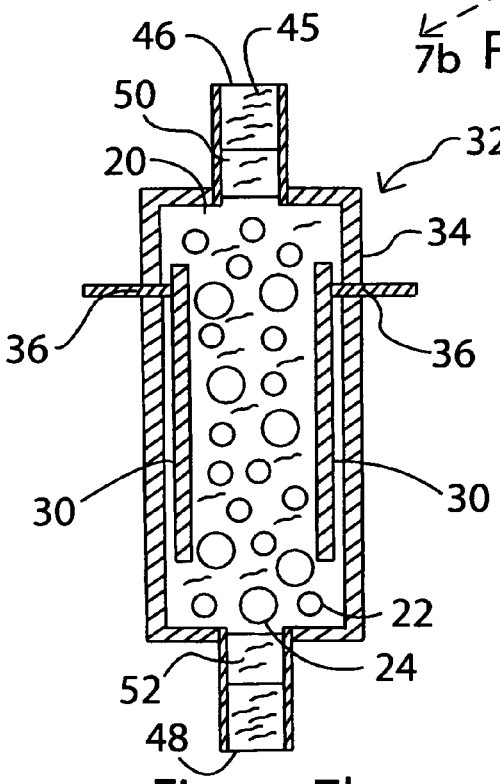
FIG. 7*b* is a side sectional view along line 7*b*-7*b* of the device in FIG. 7*a;*
Figure 7C:
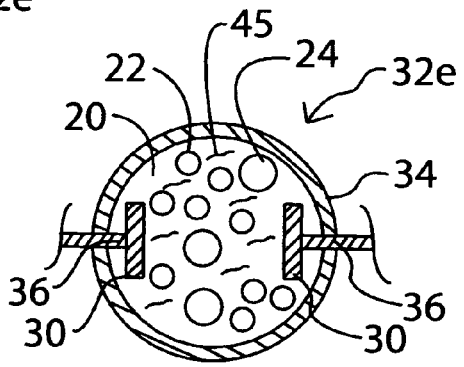
FIG. 7*c* is a top sectional view along line 7*c*-7*c* of the device in FIG. 7*a;*

In one embodiment, FIGS. 7*a*-7*c*, heat generating device 32*e* is used as a heat exchanger. Device 32*e* comprises the elements of device 32*a*, with vessel 34 having the added elements of an entrance orifice 46 and an exit orifice 48. Liquid 26 is heated by ohmic resistive heating of composition 20. Liquid 26 flows from entrance orifice through composition 20 and exits at exit orifice 48. Device 32*e* may further include a first filter 50 placed in series with entrance orifice 46 and a second filter 52 placed in series with exit orifice 48. First filter 50 and second filter 52 keep conductive particles 22 and dielectric particles 24 from exiting vessel 34. Some applications for device 32*e* are a water heater, chemical heater, heat transfer to fluids, etc.

Figure 8A:
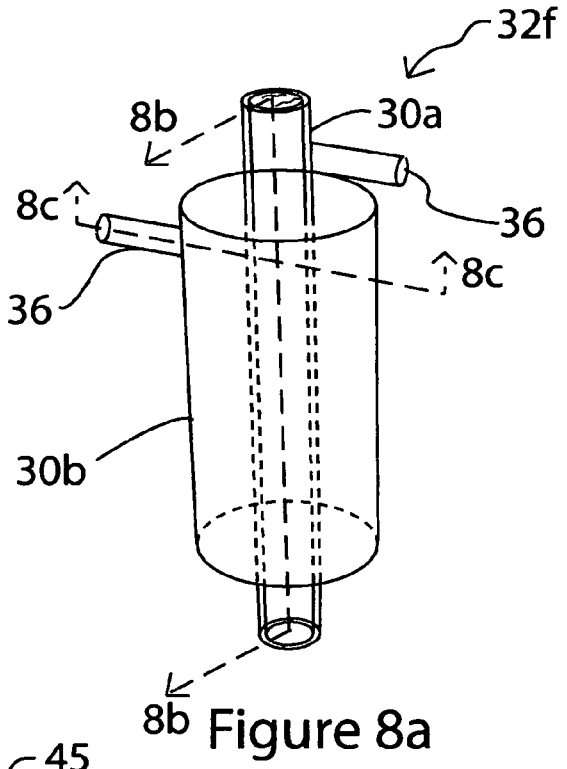
FIG. 8*a* is a perspective view of a device incorporating any of the representative compositions depicted in FIGS. 1*a* and 1*b,* the device having concentric electrodes, generating heat in the composition, and transferring that heat to a fluid passing through a tube located within the composition.
Figure 8B:
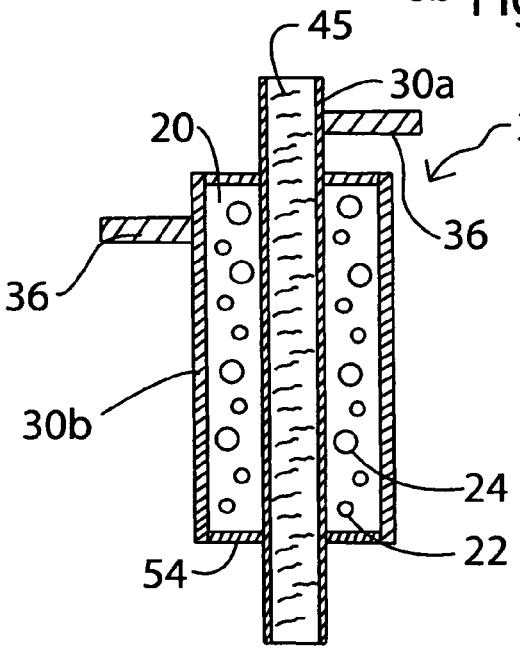
FIG. 8*b* is a side sectional view along line 8*b*-8*b* of the device in FIG. 8*a;*
Figure 8C:
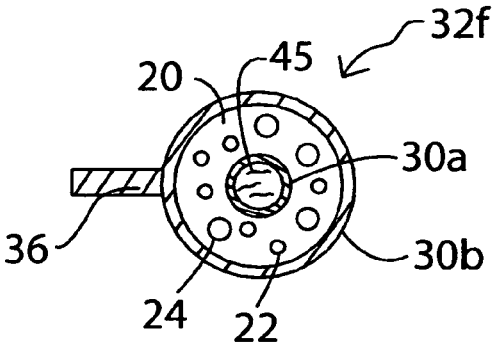
FIG. 8*c* is a top sectional view along line 8*c*-8*c* of the device in FIG. 8*a;*

In one embodiment, FIGS. 8*a*-8*c*, heat generating device 32*f* comprises an inner electrode 30*a* concentric to an outer electrode 30*b*. Outer electrode 30*b* forms the outer wall of vessel 34. Composition 20 is disposed between inner electrode 30*a* and outer electrode 30*b*. Inner electrode 30*a* and outer electrode 30*b* are electrically isolated by electrical insulator 54. Composition 20 may be any of the compositions 20' and 20"described above. Current is applied through the mixture to resistively heat the mixture. Electrodes 30 may be any one of the following materials: graphite, titanium, stainless steel, molybdenum, silver, copper, gold and platinum. Electrical leads 36 connect electrodes 30 to circuitry and a power supply (not shown). The applied current resistively heats the mixture. Device 32*a* may include multiple zones of electrodes (not shown) to heat different sections of composition 20 to different temperatures. Device 32*a* may further comprise a temperature sensor 36 and a temperature controller (not shown). Temperature controller is connected to provide electrical energy to one or more pairs of electrodes when the temperature is below a temperature set point. Inner electrode 30*a* may also be a tube that has fluid 45 flowing through the inner electrode. Fluid 45 may be a gas, liquid, mixture or slurry. Fluid 45 is heated by thermal conduction of heat generated in composition 20 across tube 44 and into the liquid. Some applications for device 32*f* are a water heater, chemical heater, heat transfer to fluids, etc.

Figure 9A:
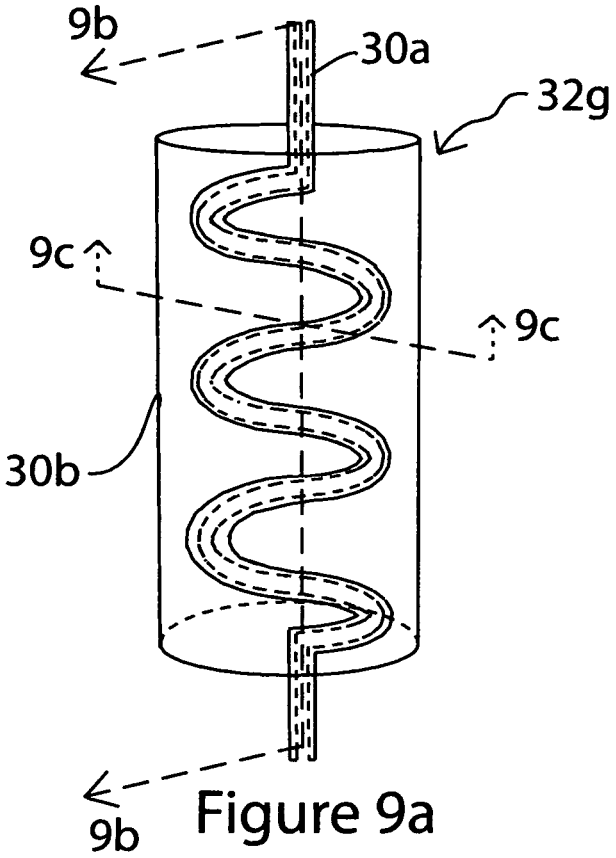
FIG. 9*a* is a perspective view of a device incorporating any of the representative compositions depicted in FIGS. 1*a* and 1*b,* the device having an inner spiral electrode, generating heat in the composition, and transferring that heat to a fluid passing through the spiral electrode located within the composition.
Figure 9B:
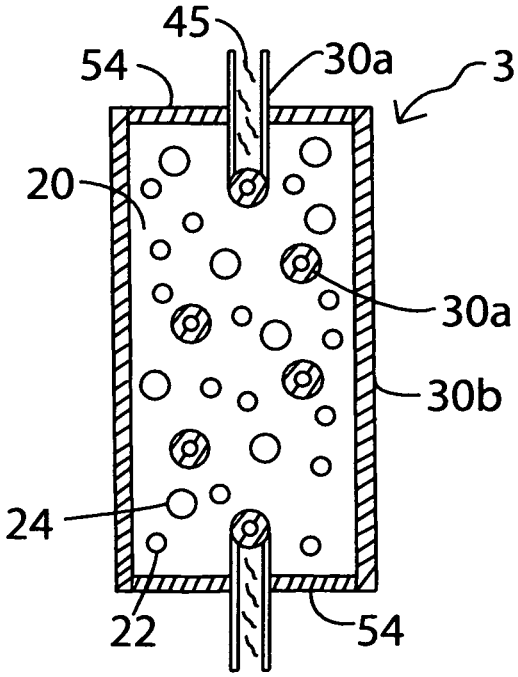
FIG. 9*b* is a side sectional view along line 9*b*-9*b* of the device in FIG. 9*a*.
Figure 9C:
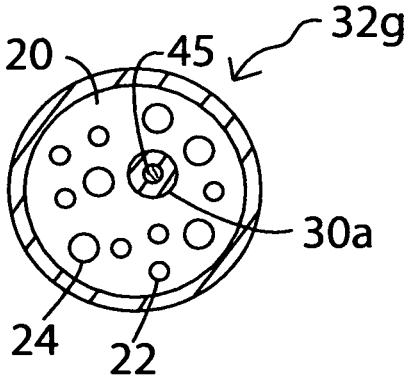
FIG. 9*c* is a top sectional view along line 9*c*-9*c* of the device in FIG. 9*a.*

In one embodiment, FIGS. 9*a*-9*c*, heat generating device 32*g* is used as a heat exchanger. Device 32*g* comprises the elements of device 32*f*, with the added element of inner electrode 30*a* being a spiral inner electrode 30*a*'. Spiral inner electrode provides additional surface area in contact with composition 20 to heat fluid 45 within. Some applications for device 32*g* are a water heater, chemical heater, heat transfer to fluids, etc.

One exemplary application using the structure of the device illustrated and describe in FIG. 5*a* is as follows. Composition 20 was used as a verified heat source to compare a temperature sensor to be verified to a reference sensor. A mixture as defined by point A in FIG. 2*b* was used for this experiment. Mixture A comprised 200 parts medium glass beads, size #8 purchased from Kramer Industries, Inc. The particles were made from soda lime type glass and had a particle size of 150-200 microns. These dielectric particles were mixed with 18 parts A60 graphite powder purchased from Ashbury Carbons, nominal 60-micron particle size with a diameter range of 25-90 microns. The mixture had a resistivity of 31.0 ohm-meters. The mixture was placed in a conformable tube of high temp silicon tubing with dimensions of (outer diameter 1.5", wall thickness of 0.07") two electrodes (titanium plates 0.038"×0.5"×4.5") were put in contact with opposite sides of the mixture. A verifying thermometer was housed in the mixture to read the precise temperature the mixture created. A power source of 120V/60 Hz was applied and a set point temperature of 71° C. was entered into a controller Athena Series 16C DIN Temperature/Process Controller. The mixture achieved set point temperature in 10-minutes, 20 seconds and maintained this temperature within 2.3° C. over 2 hours.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. A device for heating a liquid from an applied current, comprising:

a) a vessel having an entrance orifice and an exit orifice;

b) a mixture of conductive particles and dielectric particles contained within said vessel, the liquid flows from said entrance orifice through said mixture to said exit orifice;

c) a first filter placed in series with said entrance orifice, a second filter placed in series with said exit orifice, said first and second filters keep conductive particles and dielectric particles from exiting said vessel;

d) at least one pair of electrodes disposed within said mixture to direct the applied current through said mixture; and e) wherein the applied current resistively heats said mixture transferring heat to the liquid.

2. A device as recited in claim 1, further comprising a power supply for supplying the applied current.

3. A device as recited in claim 1, further comprising a temperature sensor and a temperature controller, wherein said temperature controller is connected to provide electrical energy to said at least one pair of electrodes when said temperature is below a temperature set point.

4. A device as recited in claim 1, further comprising a sleeve inserted within said mixture; wherein said sleeve creates a cavity that is void of said mixture.

5. A device as recited in claim 1, wherein said pair of electrodes are an inner electrode concentric to an outer electrode, wherein with said mixture is disposed between said inner and outer electrodes.

6. A device as recited in claim 1, wherein said conductive particles are graphite.

7. A device as recited in claim 1, wherein said conductive particles have a diameter from 1 to 1500 microns.

8. A device as recited in claim 1, wherein said dielectric particles have a diameter from 1 to 1500 microns.

9. A device as recited in claim 1, wherein said mixture has a resistivity from 0.015 ohm-meters to 2.3 megaohm-meters.

10. A device as recited in claim 1, wherein said dielectric particles are at least one from the group consisting of silicon dioxide, hydrated magnesium silicate, silicon carbide, and soda-lime glass beads.

11. A device as recited in claim 1, wherein said mixture is characterized as pourable.

12. A device as recited in claim 6, wherein said mixture is from 4-percent to 15-percent by weight of graphite.

13. A device as recited in claim 6, wherein the radius of said graphite particles divided by the radius of said dielectric particles from is 0.2 to 5.

14. A device as recited in claim 1, wherein the liquid is resistively heated by electric current flowing through the liquid.

* * * * *